United States Patent [19]

Miller

[11] 4,106,372

[45] Aug. 15, 1978

[54] ADJUSTABLE END WRENCH

[75] Inventor: Jerold R. Miller, Porterville, Calif.

[73] Assignee: Robert A. Dexter, Porterville, Calif. ; a part interest

[21] Appl. No.: 786,941

[22] Filed: Apr. 12, 1977

[51] Int. Cl.[2] ..... B25B 13/14

[52] U.S. Cl. ..... 81/143; 81/130 A; 81/135

[58] Field of Search ..... 81/130 R, 130 A, 134, 81/135, 136, 137, 138, 142, 143, 144, 129

[56] References Cited

U.S. PATENT DOCUMENTS

| | | | |
|---|---|---|---|
| 296,942 | 4/1884 | Du Shane | 81/137 |
| 678,445 | 7/1901 | Van Note | 81/143 |
| 1,652,355 | 12/1927 | Hammer | 81/130 X |
| 2,280,594 | 4/1942 | Malagrino | 81/143 |
| 2,499,609 | 3/1950 | Riordan | 81/135 |

*Primary Examiner*—N. P. Godici

*Attorney, Agent, or Firm*—Clarence A. O'Brien; Harvey B. Jacobson

[57] ABSTRACT

An adjustable wrench having a shank forming a handle and provided with a fixed jaw toward and away from which slides a movable jaw mounted on the shank. The movable jaw is selectively locked in a desired position relative to the fixed jaw by a lock arrangement including a latch disposed on the shank for movement substantially relative to the movable jaw and provided with teeth which can engage teeth provided on the movable jaw.

1 Claim, 10 Drawing Figures

ADJUSTABLE END WRENCH

BACKGROUND OF THE INVENTION

1. Field of the Invention

This invention relates generally to adjustable wrenches, and particularly to an improved positive locking action for an adjustable wrench so as to permit the jaws of the wrench to be preset to a desired opening measured with an associated scale and then locked positively so as to prevent the movable jaw from moving relative to the fixed jaw of the wrench.

2. Description of the Prior Art

It is known generally to provide adjustable wrenches which employ eccentrics which pivot about an axis transverse to the longitudinal extent of the wrench in order to bring locking teeth associated with the frame of the wrench into engagement with mating teeth provided on the movable jaw of the wrench. Examples of such arrangements can be found in U.S. Pat. Nos: 1,038,671, issued Sept. 17, 1912, to E.J. Spink; 1,451,906, issued Apr. 17, 1923, to I. C. Gellman; and 3,376,766, issued Apr. 9, 1968, to D. Vienat. A spring is normally employed with such locking devices in order to bias the member pivotally mounted on the frame of the wrench toward a position in which the mating teeth are engaged.

Other examples of adjustable wrenches which selectively engage teeth provided on the movable jaw of the wrench in order to lock the movable jaw in a predetermined or preset position can be found in U.S. Pat. Nos: 1,206,947, issued Dec. 5, 1916, to W. S. Upson; 1,436,049, issued Nov. 21, 1922, to J. F. Oliver; 1,539,987, issued June 2, 1925, to J. A. Bell; and 3,286,561, issued Nov. 22, 1966, to E. M. Norman.

SUMMARY OF THE INVENTION

It is an object of the present invention to provide an adjustable wrench having a locking arrangement comprising fewer moving parts than known arrangements of this kind.

It is another object of the present invention to provide a positive acting locking arrangement for an adjustable wrench which is rugged and reliable of construction and tends to resist clogging with dirt, and the like.

It is still another object of the present invention to provide an adjustable wrench locking arrangement which permits the jaws of the wrench to be set at a predetermined distance from one another and locked accurately at such distance.

These and other objects are achieved according to the present invention by providing an adjustable wrench having: a shank forming a handle and provided with a fixed jaw; a movable jaw mounted on the shank for movement toward and away from the fixed jaw; and a lock arrangement mounted on the shank for selectively retaining the movable jaw from movement relative to the shank and fixed jaw so as to hold the movable jaw in a predetermined relation with respect to the fixed jaw.

The shank is advantageously provided with a groove arranged extending away from the fixed jaw, and the movable jaw is provided with a tongue slidably engaged in the groove. Suitable stops provided on the movable jaw prevent the latter from sliding out of the groove once the lock arrangement is assembled on the associated wrench frame.

The lock arrangement according to the invention includes a projection provided on the movable jaw and selectively engaged by a protrusion provided on a latch mounted in a recess provided in the frame, or shank, of the wrench for generally reciprocating movement toward and away from the movable jaw. An actuator assembly is mounted on the shank for selectively moving the latch toward and away from the movable jaw and engaging the protrusion with the projection. Advantageously, the movable jaw is provided with a plurality of projections in the form of teeth, and the latch is likewise provided with a plurality of proturbances also in the form of teeth, with the teeth of the movable jaw and the latch mating with one another for realizing positive engagement between the latch and movable jaw.

The first preferred actuator assembly includes an eccentric disposed in an opening provided through the latch for rotation relative to the latch so as to function as a cam in view of rotation of the eccentric about an axis formed by a shaft journaled on the shank of the wrench. A further shaft extending in the opposite direction from the eccentric as the aforementioned shaft journaled on the shank can be attached to a handle for facilitating rotation of the eccentric in order to cam the latch between a position in which the teeth of the latch engage the teeth of the movable jaw and a position in which the teeth of the latch are disengaged from the teeth of the movable jaw.

A second preferred actuator assembly according to the invention includes a wheel forming the latch and mounted for rotation about an axis formed by a shaft journaled on the shank of the wrench in a manner similar to the shaft of the first preferred actuator assembly. Teeth provided on a peripheral portion of the wheel selectively engage the teeth of the movable jaw so as to restrain the movable jaw from movement in a direction parallel to the axis of the shaft, while a ball detent, and the like, is employed to retain the wheel in a position locking the movable jaw against movement by preventing the wheel from turning accidentally. A plurality of grooves can be provided in a portion of the periphery of the wheel so as to extend substantially parallel to the shaft on which the wheel is mounted and facilitate rotation of the wheel about the shaft.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
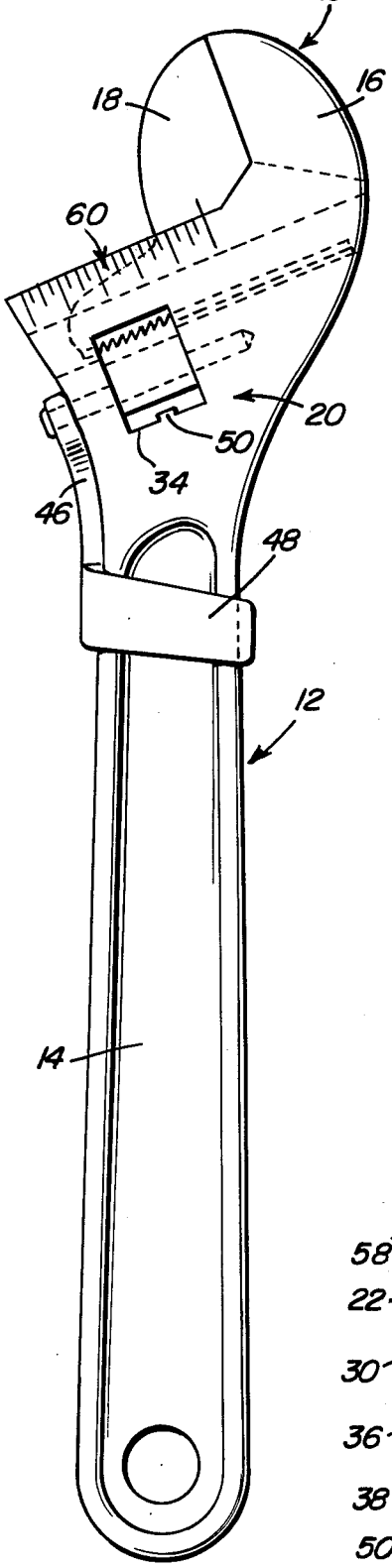
FIG. 1 is a side elevational view showing an adjustable wrench according to the present invention.
Figure 2:
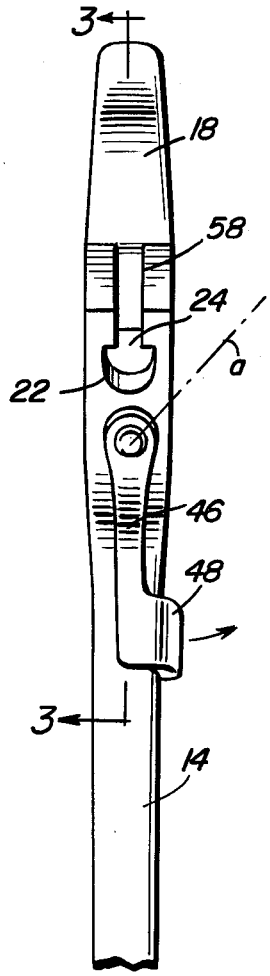
FIG. 2 is a fragmentary, end elevational view looking from the left in FIG. 1.

Referring now more particularly to FIGS. 1–5 of the drawings, an adjustable end or crescent wrench 10 according to the present invention includes a frame or shank 12 forming a handle 14 and provided with a fixed jaw 16 at one longitudinal end. While wrench 10 is illustrated as being an end wrench, it is to be understood that a wrench according to the invention may be constructed in another manner if so desired. A movable jaw 18 is mounted on shank 12 for movement toward and away from fixed jaw 16, while a lock arrangement 20 also mounted on shank 12 selectively restrains the movable jaw 18 from movement relative to shank 12 and the fixed jaw 16.

Shank 12 is provided with a longitudinally extending groove 22 which extends away from the fixed jaw in an end surface of shank 12 and slidably receives a tongue 24 provided on the lower portion of movable jaw 18. In this manner, movable jaw 18 is restricted to sliding movement toward and away from fixed jaw 16 so as to cooperate with jaw 16 and grip various articles (not shown) as is commonly done with adjustable wrenches.

Lock arrangement 20 includes one or more projections preferably in the form of teeth 26 provided on the tongue 24 of movable jaw 18 so as to be disposed in the bottom of groove 22. A latch 28 is provided with one or more protrusions preferably in the form of the illustrated teeth 30 which matingly engage with teeth 26 of jaw 18 so as to perform a positive engagement between the latch 28 and the jaw 18. An actuator assembly 32 is mounted on shank 12 for selectively moving latch 28 toward and away from movable jaw 18 in a direction substantially perpendicular to the direction of sliding movement of movable jaw 18 and engaging teeth 30 with teeth 26 in order to restrain jaw 18 from movement relative to jaw 16.

Shank 12 is provided with a recess 34 communicating with the bottom of groove 22, and it is in this recess 34 in which the latch 28, which may be of generally rectangular configuration, is slidably disposed so as to engage and disengage with teeth 26 of jaw 18.

Figure 4:
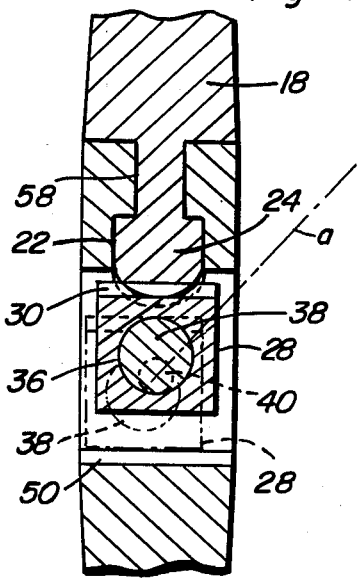
FIG. 4 is an enlarged, fragmentary, sectional view taken generally along the line 4—4 of FIG. 3.

The actuator assembly 32 includes an opening 36 provided in and extending through the latch 28 for receiving a cylindrical eccentric 38 having an axis of rotation formed by a depending shaft 40 arranged off-center of eccentric 38 and journaled in a bore 42 formed within shank 12 so as to communicate with recess 34. A further shaft 44 extends coaxially from the eccentric 38 from the opposite side of eccentric 38 and in the opposite direction to shaft 40 for receiving a handle 46 and facilitating rotation of eccentric 38 in order to reciprocate the latch 28 by a cam action. The end positions of latch 28 are seen in FIG. 4, wherein the engaged or locked position of latch 28 is shown in full lines, and the disengaged or unlocked position of the latch is shown in broken lines. The broken line designated A in FIGS. 2 and 4 indicates the longitudinal extent of handle 46 when the latch 28 is in its disengaged or broken line position as shown in FIG. 4. A leg 48 extends from handle 46 at substantially a right angle with respect thereto in order to engage the adjacent side surface of handle 14 and limit movement of the handle 46 in the locking direction of movement of handle 46, with the direction arrow in FIG. 2 indicating the direction of movement of handle 46 toward the axis A which will unlock the jaw 18 and permit movement of same.

A boss 50 is provided extending across the transverse width of the bottom surface of the recess 34 in order to provide a seat or abutment for the latch 28 when in the unlatched position. This boss 50 is advantageously extended entirely across the width of the shank 12 in order to insure that the latch 28 will be squared up when in the unlocked position and the teeth 26, 30 will not drag against one another at the end portions of latch 28. In addition, a bushing 52 is fit into the hole provided in the face of shank 12 adjacent handle 46 for permitting insertion of eccentric 38 into recess 34. As will be appreciated, the opening in shank 12 must be sufficiently large to receive the eccentric 38 in order to permit shaft 40 to be inserted into the associated bore 42. Once the eccentric 38 is in place, bushing 52 can be arranged in the enlarged portion of the hole in order to blcok same and to provide a suitable journal for the shaft 44.

Figure 3:
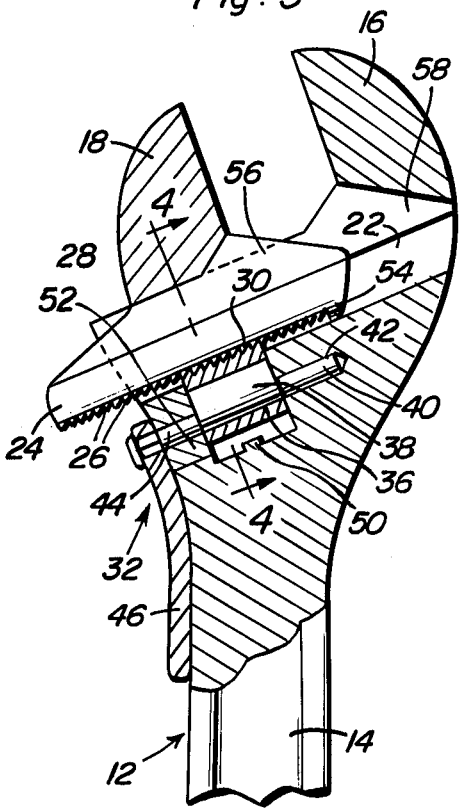
FIG. 3 is a fragmentary, sectional view taken generally along the line 3—3 of FIG. 2, but showing the jaws of the wrench in an open position.
Figure 5:
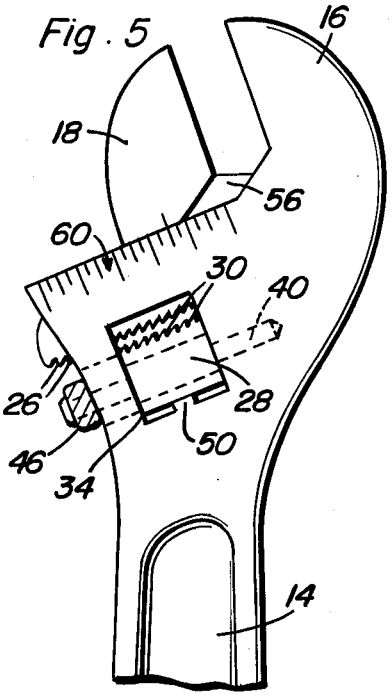
FIG 5 is a fragmentary, side elevational view, similar to FIG. 1, but showing the locking arrangement of the wrench in its disengaged mode for permitting the movable jaw of the wrench to be adjusted as desired.
Figure 6:
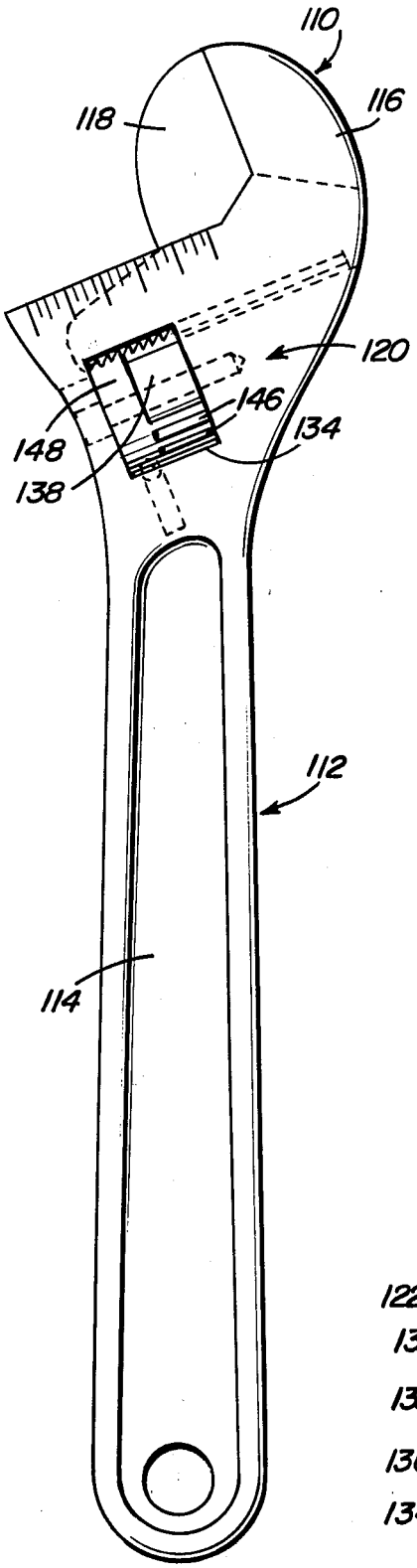
FIG. 6 is a side elevational view showing a second embodiment of an adjustable wrench according to the present invention.
Figure 7:
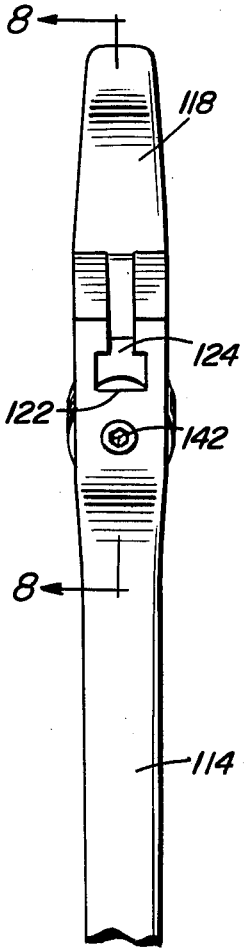
FIG. 7 is a fragmentary, end elevational view looking from the left in FIG. 6, but showing the jaws in an open position.

A lug 54 is provided on the right hand end of tongue 24, as seen in FIG. 3, engaging the bottom of groove 22 in such a manner that it extends beneath the plane of the teeth 26. When movable jaw 18 is moved to the left, as seen in FIG. 3, but with the latch 28 in the disengaged position, as seen in FIG. 5, the lug 54 will drop into recess 34 and engage the teeth 30 of latch 2 in order to prevent the movable jaw 18 from sliding out of groove 22 toward the left, as seen in FIG. 3. Further, movable jaw 18 is provided with a web 56 which rides in a channel portion 58 formed in shank 12 for permitting communication with groove 22. That is, the clamping portion of movable jaw 18 is connected to the tongue 24 thereof by the web 56 which is slidably disposed in the channel portion 58, with opposed surfaces of the latter elements mating with one another when the clamping portion of movable jaw 18 is abutting the fixed jaw 16 in order to provide a suitable stop for jaw 18 relative to jaw 16.

Indicia 60 forming a suitable scale are provided on the frame or shank 12 of wrench 10 adjacent the base of fixed jaw 16 so as to extend substantially codirectionally to the groove 22 and allow adjustment of the opening of movable jaw 18 to a required size before use. Once preset while the latch 28 is in its unlocked position, simple actuation of handle 46 as by the leg 48 will actuate the positive action of the locking arrangement 12 and cause the movable jaw 18 to be restrained from movement due to the engagement of the teeth 26 and 30. Movement of the handle 46 in the direction of the arrow of FIG. 2 will once again unlock the movable jaw 18 and permit repositioning of same.

Referring now more particularly to FIGS. 6–10 of the drawings, an adjustable end wrench 110 according to a second embodiment of the present invention includes a frame or shank 112 forming a handle 114 and provided with a fixed jaw 116 at one longitudinal end in a manner similar to wrench 10. A movable jaw 118 is mounted on shank 112 for moved toward and away from fixed jaw 116, while a lock arrangement 120 also mounted on shank 112 selectively restrains the movable jaw 118 from movement relative to shank 112 and the fixed jaw 116.

Shank 112 is provided with a longitudinally extending groove 122 which extends away from the fixed jaw 116 in an end surface of shank 112 and slidably receives a tongue 124 provided on the lower portion of movable jaw 118. Thus far, the construction of wrench 110 is essentially the same as that of wrench 10 described above, and the operation of the element described thus far for wrench 110 will operate in the same manner as the corresponding elements of the wrench 10.

Lock arrangement 120 includes one or more projections preferably in the form of teeth 126 provided on the tongue 124 of movable jaw 118 so as to be disposed in the bottom of groove 122. A latch 128 is provided with one or more protrusions preferably in the form of the illustrated teeth 130 which matingly engage with teeth 126 of jaw 118 so as to form a positive engagement between the latch 128 and the jaw 118. An actuator assembly 132 is mounted on shank 112 for selectively moving latch 128 into and out of locking engagement with the movable jaw 118 in order to restrain jaw 118 from movement relative to jaw 116.

Shank 112 is provided with a recess 134 communicating with the bottom of groove 122, and it is in this recess 134 in which the latch 128 is disposed. The actuator assembly 132 includes an opening 136 provided in and extending through a wheel, or cylindrical element, 138 of suitable configuration which is mounted rotation about an axis formed by a depending shaft 140 journaled in a bore 142 formed within shank 112 so as to communicate with recess 134. A threaded head 144 of shaft 140 is received in a threaded opening suitably provided in shaft 112 so as to communicate with recess 134 from an outer portion of shank 112 and permit the wheel 138 to be selectively retained in and removed from the recess 134. A portion of the cylindrical peripheral surface of the wheel 138 is provided with the grooves 146 which extend substantially parallel to the axis formed by shaft 140 part way across the wheel 138 so as to facilitate gripping of wheel 138 by an operator's fingers (not shown) without slipping during locking and unlocking of latch arrangement 128.

The peripheral surface of wheel 138 is also provided with a rim 148 in which is formed an indent 150 dimensioned to receive the ball of a spring and ball detent 152 disposed in a hole 154 provided in shank 112 so as to communicate with the bottom surface of recess 134.

Figure 8:
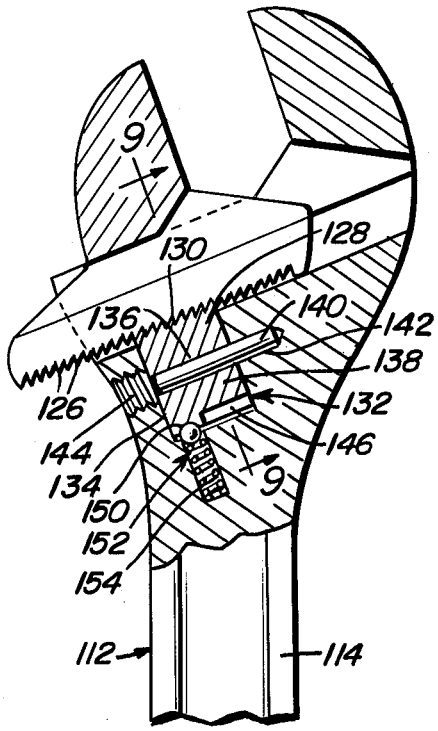
FIG. 8 is a fragmentary, sectional view taken generally along the line 8—8 of FIG. 7.
Figure 9:
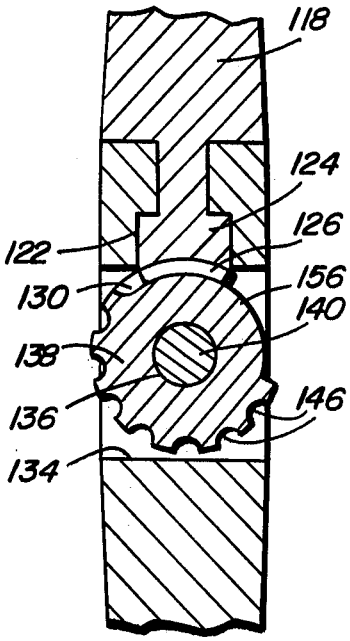
FIG. 9 is an enlarged, fragmentary, sectional view taken generally along the line 9—9 of FIG. 8.
Figure 10:
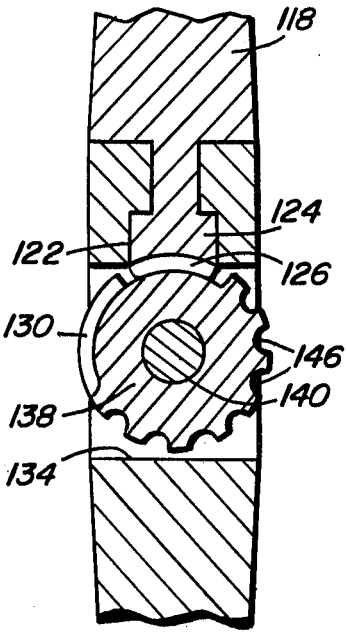
FIG. 10 is an enlarged, fragmentary, sectional view similar to FIG. 9, but showing the lock arrangement in a position releasing the removable jaw of the wrench for adjustment relative to the fixed jaw thereof.

As can be seen from FIGS. 9 and 10, the teeth 130 provided on wheel 138 extend only over a small segment of the peripheral surface of the wheel 138 so as to engage and disengage with the teeth 126 provided on jaw 118 by rotation of wheel 138 between the positions shown in FIGS. 9 and 10, respectively. That is, the latch 128 has three areas on its circumference, with one of the areas containing the teeth 130, a second area in which the grooves 146 are provided, and a third area designated 156 in FIG. 9 which is that open area between the other two areas, or between the teeth 130 and the grooves 146, which permits the movable jaw 118 to slide relative to fixed jaw 116. Thus, in the locked position the teeth area on the latch 128 is engaged with the teeth 126 on movable jaw 118. To unlock movable jaw 118, one turns wheel 138 of latch 128 so that teeth 126 on jaw 118 are opposite the open area 156 on latch 126. The distance between the movable jaw 118 and the fixed jaw 116 can be set by a scale suitably provided on frame 112 in a manner similar to the indicia 60 provided on frame 12 of wrench 10. The spring and ball detent 152 will engage with indent 150 when the lock arrangement 120 is in its locked position as shown in FIGS. 8 and 9, so as to keep latch 128 from turning accidentally and unlocking wrench 110.

As can be readily understood from the above description and from the drawings, an adjustable wrench according to the present invention provides a simple, yet rugged and reliable positive action for holding the movable jaw of the wrench at a desired setting. The elements of the lock arrangement of the invention are such as to resist wear and insure long life for the device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An adjustable wrench, comprising, in combination:

(a) a frame provided with a fixed jaw;

(b) a movable jaw mounted on the frame for movement toward and away from the fixed jaw; and (c) lock means mounted on the frame for selectively restraining the movable jaw from movement relative to the frame and fixed jaw, the lock means including, in combination:

(1) a projection provided on the movable jaw;

(2) a latch provided with a protrusion arranged for selective engagement with the projection of the movable jaw; and (3) actuator means mounted on the frame for moving the protrusion provided on the latch toward and away from the movable jaw and selectively engaging the protrusion with the projection in order to restrain the movable jaw from movement, the actuator means including, in combination:

(4) the latch being provided with a through opening, with the movable jaw being provided with a plurality of projections in the form of teeth, and the latch being provided with a plurality of protrusions also in the form of teeth mating with the teeth of the movable jaw so that the teeth of the latch can selectively engage with the teeth of the movable jaw, the frame forming a manipulating handle and being provided with a groove arranged extending away from the fixed jaw, the movable jaw being provided with a tongue slidably engaged in the groove, the frame also being provided with a through recess communicating with the groove provided in the frame, and the latch being slidably disposed in the recess;

(5) a cylindrical eccentric having a depending shaft arranged substantially parallel to the groove and off center of the eccentric and journaled on the frame, with the eccentric conforming with and being arranged in the opening of the latch for moving the latch by cam action by rotation of the eccentric; and (6) an actuation handle affixed to the shaft of the eccentric for facilitating rotation of same.

* * * * *